US009352454B1

(12) United States Patent
Aldredge et al.

(10) Patent No.: US 9,352,454 B1
(45) Date of Patent: May 31, 2016

(54) ONE HANDED LOCKING PLIERS

(71) Applicants: Robert L. Aldredge, Englewood, OH (US); Daniel J Schaefer, Huber Heights, OH (US)

(72) Inventors: Robert L. Aldredge, Englewood, OH (US); Daniel J Schaefer, Huber Heights, OH (US)

( * ) Notice: Subject to any disclaimer, the term of this patent is extended or adjusted under 35 U.S.C. 154(b) by 0 days.

(21) Appl. No.: 14/843,070

(22) Filed: Sep. 2, 2015

(51) Int. Cl.
*B25B 7/12* (2006.01)

(52) U.S. Cl.
CPC ..... *B25B 7/123* (2013.01)

(58) Field of Classification Search
CPC ..... B25B 7/10; B25B 7/12; B25B 7/123
USPC ..... 81/368–380
See application file for complete search history.

(56) References Cited

U.S. PATENT DOCUMENTS 2,496,309 A * 2/1950 Pugh ..... B25B 7/123 81/380
3,241,410 A * 3/1966 Paden ..... B25B 5/12 81/110
5,056,385 A 10/1991 Petersen
5,385,072 A * 1/1995 Neff ..... B25B 7/04 81/356
5,609,080 A * 3/1997 Flavigny ..... B25B 7/123 81/368
6,095,019 A 8/2000 Warheit et al.
7,134,365 B2 * 11/2006 Hile ..... B25B 7/123 81/368
7,313,989 B1 * 1/2008 Tortolani, Jr. ..... B25B 5/127 81/355
7,762,162 B2 7/2010 Phillips, Sr. et al.
8,656,813 B1 2/2014 Aldredge et al.

* cited by examiner

*Primary Examiner* — Hadi Shakeri
(74) *Attorney, Agent, or Firm* — Donald J. Ersler

(57) ABSTRACT

A one handed locking pliers preferably includes a fixed jaw, a moveable jaw, a fixed handle, a toggle link, a power link and a moveable handle. The fixed jaw is retained in a first end of the fixed handle. The moveable jaw is pivotally retained in substantially the one end of the fixed handle. An adjustment screw is retained in a second end of the fixed handle. An end of the adjustment screw engages a first end of the toggle link. The moveable handle includes a lengthwise portion and an upper portion, which extends from an end of the handle portion. The moveable jaw is pivotally engaged with a first corner of the power link. A second corner of the power link is pivotally engaged with a second end of the toggle link. A third corner of the power link is pivotally engaged with the moveable handle.

10 Claims, 6 Drawing Sheets

ONE HANDED LOCKING PLIERS

BACKGROUND OF THE INVENTION

1. Field of the Invention

The present invention relates generally to hand tools and more specifically to a one handed locking pliers, which requires less effort to operate than that of the prior art.

2. Discussion of the Prior Art

U.S. Pat. No. 5,056,385 to Petersen discloses a compound toggle link. U.S. Pat. No. 6,095,019 to Warheit et al. discloses a locking pliers tool. U.S. Pat. No. 7,762,162 to Phillips, Sr. et al. discloses a locking pliers with cam. U.S. Pat. No. 8,656,813 to Aldredge et al. discloses a locking pliers.

Accordingly, there is a clearly felt need in the art for a one handed locking pliers, which requires less effort to operate than that of the prior art.

SUMMARY OF THE INVENTION

The present invention provides a one handed locking pliers, which requires less effort to operate than that of the prior art. The one handed locking pliers (locking pliers) preferably includes a fixed jaw, a moveable jaw, a fixed handle, an adjusting screw, a toggle link, a power link and a moveable handle. The phrase, "one handed" means that the locking pliers is operable with a single hand, which allows the other hand to manipulate an object to be clamped in the jaws of the locking pliers. The fixed jaw, the moveable jaw, the fixed handle, the adjusting screw and a biasing spring are preferably taken from an Irwin item no. 502L3 vise grips, but other parts may also be used. U.S. Pat. No. 5,056,385 is hereby incorporated into this patent application by reference in its entirety. The fixed jaw is retained in one end of the fixed handle and the adjusting screw is threadably retained in an opposing end of the fixed handle. The moveable jaw is pivotally retained in the one end of the fixed handle.

The toggle link includes a first end, a second end and an upper pivot point. A curved surface is formed in the first end to receive an end of the adjusting screw. The power link includes a first leg, a second leg and a cross member. The first leg is spaced apart from the second leg with the cross member. The first and second legs include a first corner, a second corner and a third corner. The second end of the toggle link is pivotally retained on the second corner, between the first and second legs with a first toggle pin. The moveable handle includes a U-shaped cross section having a first handle leg and a second handle leg. The moveable handle also includes a lengthwise portion and an upper portion, which extends from one end of the lengthwise portion. One end of a tie link is pivotally engaged with the upper pivot point of the toggle link with a first tie pin. An opposing end of the tie link is pivotally engaged with an end of the upper leg with a second tie pin, between the first and second handle legs.

The third corner of the power link is pivotally engaged with the moveable handle with a first power pin at the one end of the lengthwise portion. An inner width between the first and second handle legs is preferably sized to receive an outer width of the power link. The first corner of the power link is pivotally engaged with the moveable jaw with a first jaw pin. The moveable jaw is retained between the first and second legs of the power link.

A second embodiment of the locking pliers replaces the tie link and the upper pivot point of the toggle link with a slot. The slot eliminates the need for the tie link. The slot in the toggle link slidably receives a second tie pin pressed through an end of the upper portion of the moveable handle.

Accordingly, it is an object of the present invention to provide a locking pliers, which requires less effort to operate than that of the prior art.

These and additional objects, advantages, features and benefits of the present invention will become apparent from the following specification.

DETAILED DESCRIPTION OF THE PREFERRED EMBODIMENTS

Figure 1:
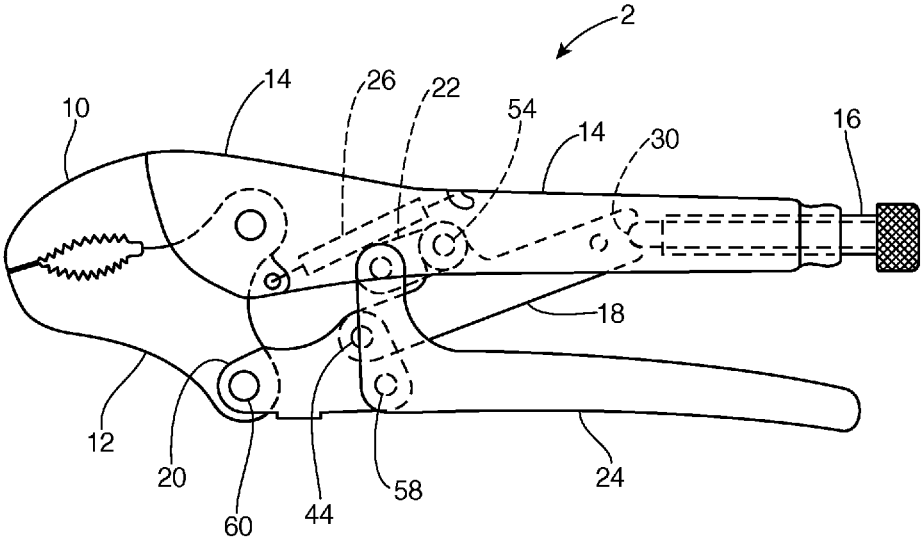
FIG. 1 is a side view of a locking pliers in a closed orientation in accordance with the present invention.
Figure 2:
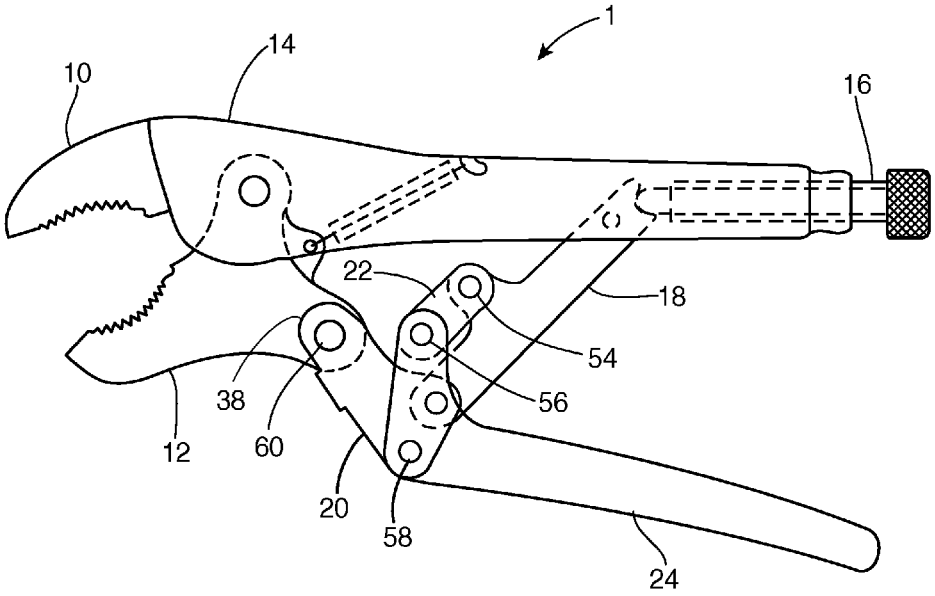
FIG. 2 is a side view of a locking pliers in an open orientation in accordance with the present invention.
Figure 3:
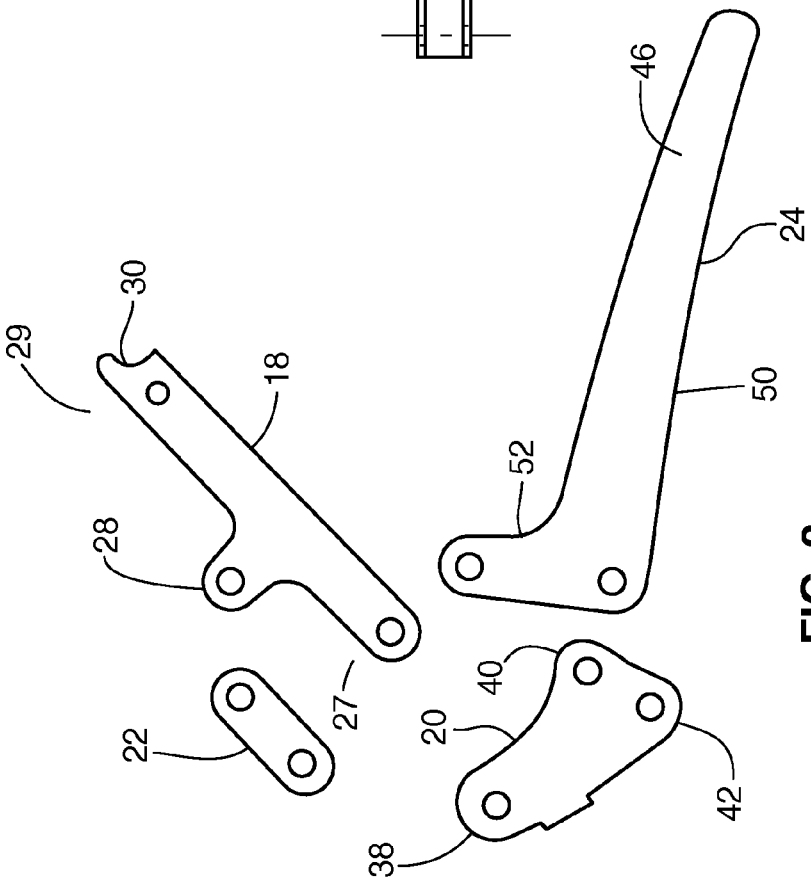
FIG. 3 is an exploded side view of a toggle link, a tie link, a power link and a moveable handle of a locking pliers in an open orientation in accordance with the present invention.
Figure 6:
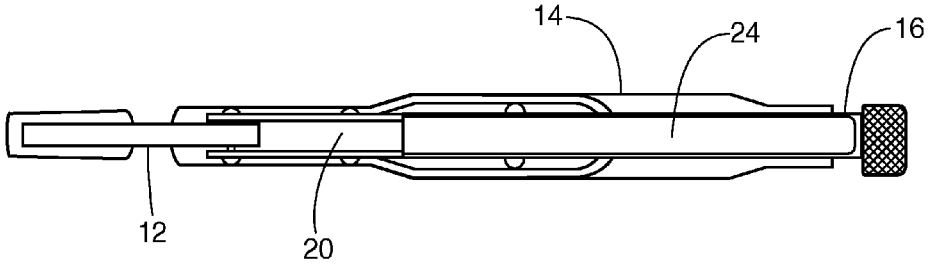
FIG. 6 is a bottom view of a locking pliers in a closed orientation in accordance with the present invention.

With reference now to the drawings, and particularly to FIG. 1, there is shown a side view of a locking pliers 1 in a closed orientation. With reference to FIGS. 2, 3 and 6, the locking pliers 1 preferably includes a fixed jaw 10, a moveable jaw 12, a fixed handle 14, an adjusting screw 16, a toggle link 18, a power link 20, a tie link 22 and a moveable handle 24. The phrase, "one handed" means that the locking pliers 1 is operable with a single hand, which allows the other hand to manipulate an object to be clamped in the jaws of the locking pliers 1. The fixed jaw 10, the moveable jaw 12, the fixed handle 14, the adjusting screw 16 and a biasing spring 26 are preferably taken from an Irwin item no. 502L3 vise grips, but other parts may also be used. U.S. Pat. No. 5,056,385 is hereby incorporated into this patent application by reference in its entirety. The fixed jaw 10 is retained in one end of the fixed handle 14 and the adjusting screw 16 is threadably retained in an opposing end of the fixed handle 14. The moveable jaw 12 is pivotally retained in the one end of the fixed handle 14.

Figure 5:
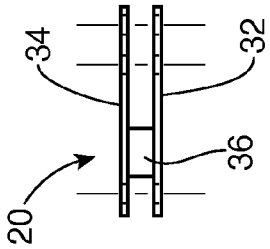
FIG. 5 is a top view of a power link of a locking pliers in accordance with the present invention.

The toggle link 18 includes a first end 27, a second end 29 and upper pivot point 28. A curved surface 30 is formed in the first end to receive an end of the adjusting screw 16. With reference to FIG. 5, the power link 20 includes a first leg 32, a second leg 34 and a cross member 36. The first leg 32 is spaced apart from the second leg 34 with the cross member 36. The first and second legs 32, 34 include a first corner 38, a second corner 40 and a third corner 42. The second end 29 of the toggle link 18 is pivotally retained on the second corner 40 of the power link 20, between the first and second legs, 32, 34 with a first toggle pin 44.

Figure 4:
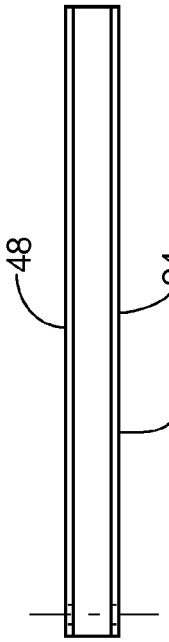
FIG. 4 is a top view of a moveable handle of a locking pliers in accordance with the present invention.

With reference to FIG. 4, the moveable handle includes a U-shaped cross section having a first handle leg 46 and a second handle leg 48. The moveable handle 24 also includes a lengthwise portion 50 and an upper portion 52, which extends from one end of the lengthwise portion 50. One end of the tie link 22 is pivotally engaged with the upper pivot point 28 of the toggle link 18 with a first tie pin 54. An opposing end of the tie link 22 is pivotally engaged with an end of the upper portion 52 of the moveable handle 24 with a second tie pin 56, between the first and second handle legs 46, 48.

The third corner 42 of the power link 20 is pivotally engaged with the moveable handle 24 with a first power pin 58 at the one end of the lengthwise portion 50. An inner width between the first and second handle legs 46, 48 is sized to receive an outer width of the power link 20. The first corner 38 of the power link 20 is pivotally engaged with the moveable jaw 12 with a first jaw pin 60. The moveable jaw 12 is retained between the first and second legs 32, 34 of the power link 20.

Figure 1A:
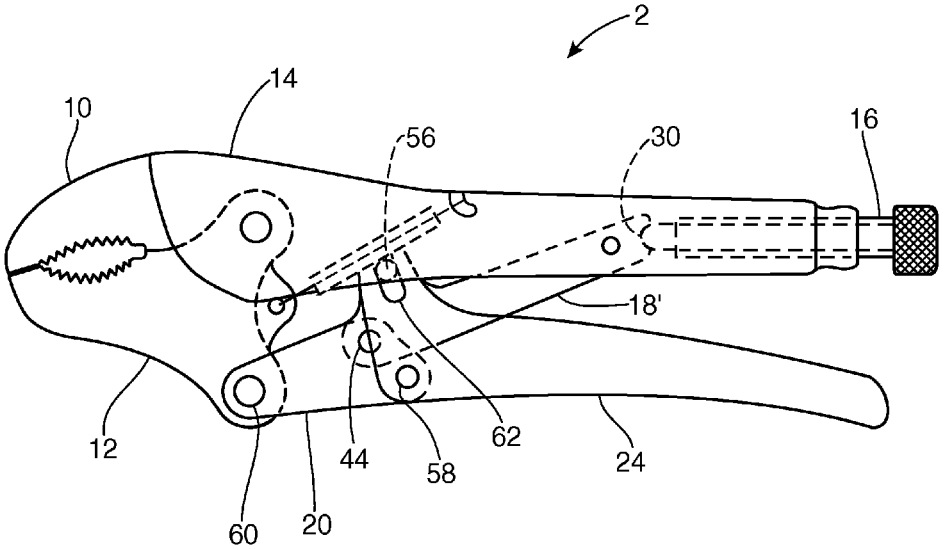
FIG. 1*a* is a side view of a locking pliers with an alternative toggle link in a closed orientation in accordance with the present invention.
Figure 2A:
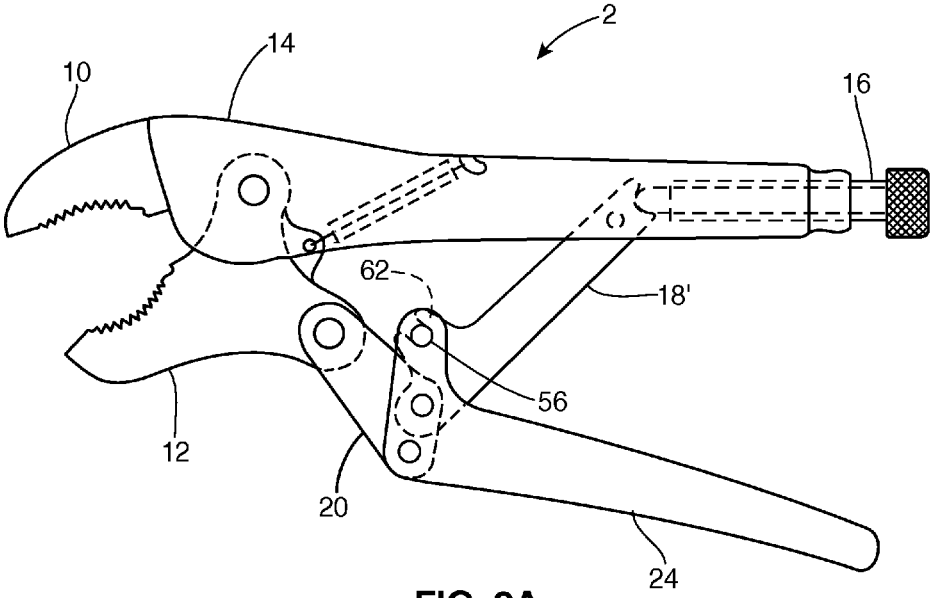
FIG. 2*a* is a side view of a locking pliers with an alternative toggle link in an open orientation in accordance with the present invention.
Figure 2B:
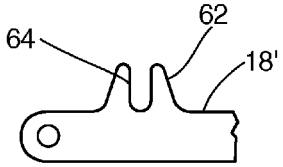
FIG. 2*b* is a partial side view of an alternative toggle link of a locking pliers in accordance with the present invention.

With reference to FIGS. 1*a*, 2*a* and 2*b*, a second embodiment of the locking pliers 2 replaces the tie link 22 and the upper pivot point 28 of the toggle link 18 with a slot projection 62. A slot 64 is formed in the slot projection 62. The slot 64 eliminates the need for the tie link 22. The slot 64 in a toggle link 18' slidably receives the second tie pin 56.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A one handed locking pliers comprising:

a fixed handle having an adjusting device disposed on one end;

a fixed jaw is rigidly retained in an opposing end of the fixed handle;

a moveable jaw is pivotally retained in substantially the opposing end of the fixed handle;

a power link having a first corner, a second corner and a third corner, said first corner is pivotally engaged with said moveable jaw;

a moveable handle includes a lengthwise portion and an upper portion, said upper portion extends from an end of said lengthwise portion, a link pin is inserted through a distal end of said upper portion; and a toggle link having a first end, a second end and a slot projection, said first end of said toggle link is in contact with an end of said adjusting device, said second end of said toggle link is pivotally engaged with said second corner of said power link, said third corner of said power link is pivotally engaged with said moveable handle, said link pin is slidably engaged with said slot projection.

2. The locking pliers of claim 1 wherein:

said adjusting device is an adjustment screw.

3. The locking pliers of claim 1 wherein:

said moveable handle includes a U-shaped cross section having a first handle leg and a second handle leg.

4. The locking pliers of claim 3 wherein:

an inner width of said moveable handle is sized to receive an outer width of said power link.

5. The locking pliers of claim 1 wherein:

said power link includes a first leg, a second leg and a cross member, said cross member retains said first leg relative to said second leg.

6. A one handed locking pliers comprising:

a fixed handle having an adjusting device disposed on one end;

a fixed jaw is rigidly retained in an opposing end of the fixed handle;

a moveable jaw is pivotally retained in substantially the opposing end of the fixed handle;

a power link having a first corner, a second corner and a third corner, said first corner is pivotally engaged with said moveable jaw;

a moveable handle includes a lengthwise portion and an upper portion, said upper portion extends from an end of said lengthwise portion;

a toggle link having a first end, a second end and an upper pivot point, said first end of said toggle link is in contact with an end of said adjusting device, said second end of said toggle link is pivotally engaged with said second corner of said power link, said third corner of said power link is pivotally engaged with said end of said lengthwise portion; and a tie link having one end pivotally engaged with said upper pivot point, an opposing end of said tie link is pivotally engaged with a distal end of said upper portion.

7. The locking pliers of claim 6 wherein:

said adjusting device is an adjustment screw.

8. The locking pliers of claim 6 wherein:

said moveable handle includes a U-shaped cross section having a first handle leg and a second handle leg.

9. The locking pliers of claim 8 wherein:

an inner width of said moveable handle is sized to receive an outer width of said power link.

10. The locking pliers of claim 6 wherein:

said power link includes a first leg, a second leg and a cross member, said cross member retains said first leg relative to said second leg.

* * * * *